US008277904B2

(12) United States Patent
Su et al.

(10) Patent No.: US 8,277,904 B2
(45) Date of Patent: Oct. 2, 2012

(54) METHOD FOR PRODUCING THERMOELECTRIC MATERIAL

(75) Inventors: Wei-Sheng Su, Taipei (TW); Chia-Hung Kuo, Tainan (TW); Ya-Wen Chou, Tainan (TW); Jie-Ren Ku, Kaohsiung (TW); Ming-Shan Jeng, Taipei County (TW); Chii-Shyang Hwang, Tainan (TW); Zong-Hao Wu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 36 days.

(21) Appl. No.: 12/845,779

(22) Filed: Jul. 29, 2010

(65) Prior Publication Data

US 2011/0223350 A1 Sep. 15, 2011

(30) Foreign Application Priority Data

Mar. 10, 2010 (TW) ..... 99106968 A

(51) Int. Cl.
*B27C 71/02* (2006.01)
*B05D 3/10* (2006.01)
*B05D 1/18* (2006.01)

(52) U.S. Cl. ..... 427/532; 427/304; 427/443.1

(58) Field of Classification Search ..... 427/304, 427/305, 437, 443.1
See application file for complete search history.

(56) References Cited

U.S. PATENT DOCUMENTS 6,793,875 B1 * 9/2004 Shaw et al. ..... 419/18
2001/0055685 A1 * 12/2001 Kaneyoshi ..... 428/403

OTHER PUBLICATIONS

Zhang et al, Thermodynamic Behavior of Copper-Coated Silicon Carbide Particles during Conventional Heating and Spark Plasma Sintering, J. Am. Ceram. Soc., 2003, vol. 86 [8], p. 1446-1448.*

* cited by examiner

*Primary Examiner* — Dah-Wei Yuan
*Assistant Examiner* — Nga Leung V Law
(74) *Attorney, Agent, or Firm* — Jianq Chyun IP Office

(57) ABSTRACT

A method for producing a thermoelectric material is provided. A semiconductor material powder is provided. An electroless plating process is preformed to deposit metal nano-particles on the surface of semiconductor material powder. An electrical current activated sintering process is performed to form a thermoelectric material having one and plurality grain boundaries.

11 Claims, 3 Drawing Sheets

METHOD FOR PRODUCING THERMOELECTRIC MATERIAL

CROSS-REFERENCE TO RELATED APPLICATION

This application claims the priority benefit of Taiwan application serial no. 99106968, filed on Mar. 10, 2010. The entirety of the above-mentioned patent application is hereby incorporated by reference herein and made a part of this specification.

TECHNICAL FIELD

The disclosure relates to a method for producing a thermoelectric material, and more generally to a method for producing a thermoelectric material having a high thermoelectric figure of merit ZT.

BACKGROUND

Thermoelectric material is one of the simplest technologies for energy conversion. Through conduction electrons of thermoelectric material, heat energy transfer to electrical power or move from cold side to hot side in a non-mechanical manner. Therefore, thermoelectric material has the potential for applying in cogeneration, portable electric power and air-conditions system.

The energy conversion efficiency of a thermoelectric material is closely related to the dimensionless thermoelectric figure of merit ZT. The thermoelectric figure of merit $ZT=S^2\sigma/k$, wherein S is a Seebeck coefficient, σ is an electrical conductivity, and k is a thermal conductivity. With increasing performance of the thermoelectric material, the efficiency of a thermoelectric cooler or a thermoelectric power generator will be increased. Conventional thermoelectric materials, have been developed from 1960's, is limited to ZT=1.0 at room temperature. Currently, many researches focus on the development of thermoelectric material with nanostructure and ZT got important breakthrough to 1.5 to 2.0.

A high performance thermoelectric material is with high Seebeck coefficient, high electrical conductivity and low thermal conductivity. Since an increase in Seebeck coefficient normally implies with a decrease in electrical conductivity. Increasing carrier concentration means an increment of electrical conductivity and implies the decreasing in Seebeck coefficient and increasing in thermal conductivity. Therefore, the material is intrinsically with the limitation of ZT value.

To enhance the thermoelectric figure of merit, the main research focuses on the development of nanostructurenanostructurenano composite thermoelectric material which having a small energy band gap. That is, the optimization between the Seebeck coefficient, thermal conductivity and electrical conductivity is obtained by changing the dopant, doping level and the nanostructure of the material, so as to achieve the maximum thermoelectric figure of merit value.

SUMMARY OF THE INVENTION

The disclosure provides a method for producing a thermoelectric material is with high dimensionless thermoelectric figure of merit.

The disclosure further provides a method for producing a thermoelectric material, and significantly enhances the electrical conductivity and decrease thermal conductivity in the same time.

The disclosure provides a method for producing a thermoelectric material. First, a semiconductor material powder is provided. Thereafter, an electroless plating processes deposit metal nano-particles on the surface of semiconductor material powder. Subsequently, an electrical current activated sintering process is performed to fabricate a thermoelectric material with one and plurality grain boundaries.

The disclosure further provides a method for producing a thermoelectric material. A sensitized semiconductor material powder mixed into a metal ion solution, wherein a part or all of metal ions attach on the surface of semiconductor powder. Afterwards, as reducing agent added into the mixture, the metal ions attached on the surface of semiconductor material powder are reduced to metal nano-particles deposit on the surface of semiconductor material powder. Furthermore, an electrical current activated sintering process is performed to form a thermoelectric material with one and plurality grain boundaries.

As mentioned above, in the process of producing the nanostructured thermoelectric material of the disclosure, the electroless plating process is performed to deposit nano-particles on the surface of a semiconductor material powder, and an electrical current activated sintering process is then performed, so that the produced thermoelectric material can has a better Seebeck coefficient, a higher electrical conductivity and a lower thermal conductivity, and thus has a higher thermoelectric figure of merit value.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
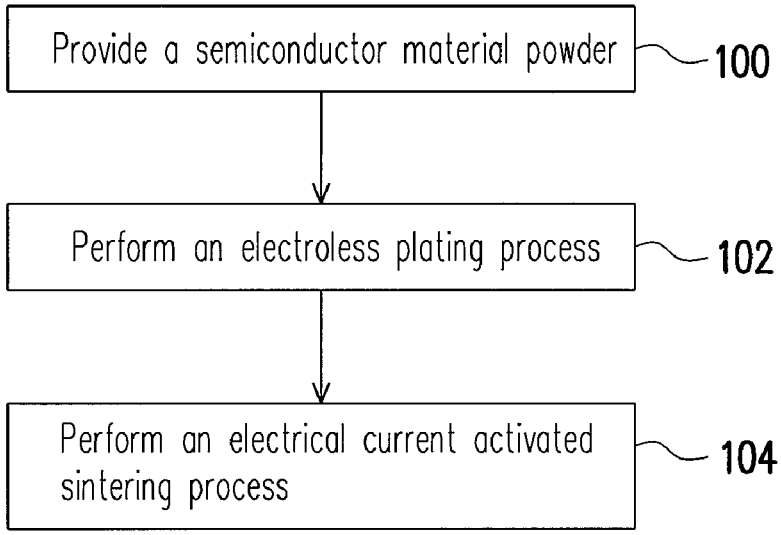
FIG. 1 illustrates a process flow of a thermoelectric material according to an exemplary embodiment.

FIG. 1 illustrates a process flow of a thermoelectric material according to an exemplary embodiment. Referring to FIG. 1, in the step 100, a semiconductor material powder is provided. The grain size of the semiconductor material power is less than 200 nm, and the particle diameter of the same is less than 100 μm, for example. The material of the semiconductor material powder can be PbTe, for example. In an exemplary embodiment, the semiconductor material powder can be formed by grinding a whole-piece semiconductor material, for example. The grinding method can be a high energy ball milling process, for example. Further, in another exemplary embodiment, the semiconductor material powder can be formed by directly performing a smelting process or a chemical synthesis process. The smelting process or the chemical synthesis process is well-known to persons skilled in the art, and the details are not illustrated herein.

Thereafter, in the step 102, an electroless plating process is performed to deposit one and plurality metal nano-particles on the surface of semiconductor material powder. The material of the metal nano-particles can be silver (Ag), tin (Sn), copper (Cu) or palladium (Pd), for example. The material of the metal nano-particles can be selected depending on the conductivity type of the thermoelectric material to be formed. For example, when the required thermoelectric material is N-type, silver can be selected as the material of the metal nano-particles; when the required thermoelectric material is P-type, tin can be selected as the material of the metal nano-particles.

The silver nano-particles are taken as an example to illustrate the electroless plating process of the disclosure in the following. First, a sensitization is performed to the semiconductor material powder provided in the step 100. Thereafter, the semiconductor material powder is centrifugal extracted and then immersed into silver ammonia solution. The silver ions are attached on the surface of semiconductor material powders. The semiconductor material powders are centrifugal extracted. Next, the extracted semiconductor powders immerse into reducing agent and silver ions reduced to silver nano-particles deposit on the surface of semiconductor material powder. Last, centrifugal extraction and a water rinse are performed to get one and plurality dry semiconductor powder. It is noted that in this electroless plating process, the reducing agent is added after the silver ions are attached on the surface of semiconductor material powder. However, in another electroless plating process, as the semiconductor material powder immerse into the silver ammonia solution, the reducing agent add to this solution in the same time.

During the electroless plating process, a solution containing reducing ions with high adhesion to the surface of semiconductor material powder is selected as the reducing agent, so that the surface of the semiconductor material powder is functionalized to attract more metal nano-particles to deposit on the surface of the semiconductor material powder uniformly.

Figure 2:
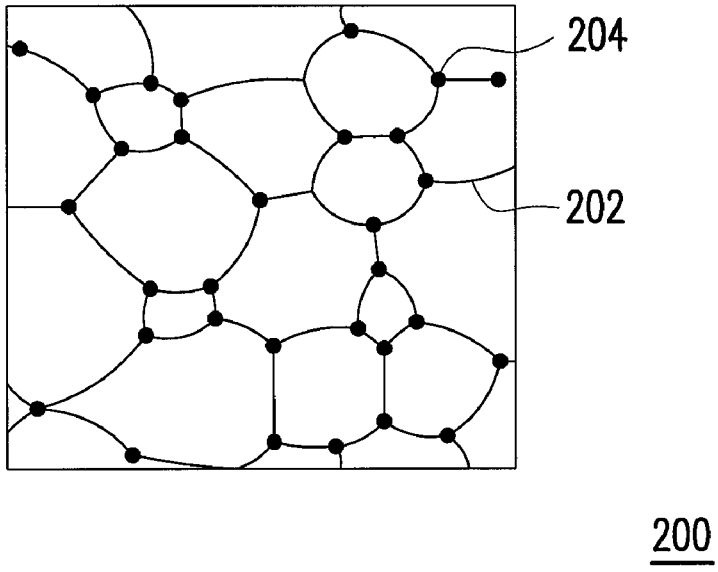
FIG. 2 schematically illustrates a structure of a thermoelectric material according to an exemplary embodiment.

Afterwards, in the step 104, an electrical current activated sintering process is performed to the semiconductor material powder with the metal nano-particles deposited thereon, so as to form a thermoelectric material with one and plurality grain boundaries. The electrical current activated sintering process can be a spark plasma sintering (SPS) process, for example. After the electrical current activated sintering process, a part of the metal nano-particles are doped into the thermoelectric material for adjusting the conductivity type of the thermoelectric material, and further adjusting the thermoelectric property of the same. In addition, another part of the metal nano-particles are still present on the grain boundary to produce one and plurality nano-heterogeneous boundaries, as shown in FIG. 2. In FIG. 2, the thermoelectric material 200 has grain boundary 202, and metal nano-particles 204 are present on the grain boundary 202.

During the electrical current activated sintering process, a solid solution is formed by a part of the metal nano-particles and the semiconductor material powder, so as to increase the carrier concentration and the thermoelectric power factor. Further, the lower sintering temperature and the shorter sintering time, compared with conventional smelting process, reduced the atomic diffusion effect and effectively maintained the micro- or nano-structure inside the thermoelectric material. In addition, a part of the metal nano-particles are present on the grain boundary to produce one and plurality nano-heterogeneous boundaries, so as to cause an effect similar to the quantum effect, thereby enhancing the Seebeck coefficient. Moreover, during the electrical current activated sintering process, the metal nano-particles on the grain boundary can produce the scattering effect for phonons, and the metal nano-particles can restrain the grain growth of the semiconductor material while maintain the nano-grains of the same. Accordingly, the metal nano-particles can effectively reduce the thermal conductivity.

An electroless plating process is performed to deposit metal nano-particles on the surface of semiconductor material powders, and an electrical current activated sintering process is then performed to produce a thermoelectric material. In some exemplary embodiments, the metal nano-particles can be uniformly distributed on the surface of the semiconductor material powder, the thermoelectric power factor can be increased, the microcrystalline structure can be maintained in the material, the Seebeck coefficient can be increased and the thermal conductivity can be reduced.

An example and a comparative example are provided below to illustrate a method for producing a thermoelectric material of the disclosure.

EXAMPLE

First, PbTe powder was dipped in a solution formed by HCl and $SnCl_2$, and the mixture was stirred with a magnetic stirring bar at room temperature for range 1 to 5 minutes, so that $Sn^{2+}$ ions were adsorbed on the PbTe powder to complete the sensitization of the PbTe powder. Thereafter, the PbTe powder was centrifugal extracted. Afterwards, the extracted one and plurality PbTe powders immerse into silver ammonia solution formed by NaOH, $NH_4OH$ and $AgNO_3$. Meanwhile, the $Sn^{2+}$ ions on the PbTe powder made $Ag^+$ ions attach on the surface of PbTe powder and centrigual extracted the PbTe powder. Further, the extracted one and plurality PbTe powders immerse into reducing agent containing $C_6H_{12}O_6$, so that the $Ag^+$ ions attached on the PbTe powder were reduced to Ag nano-particles deposit on the surface of PbTe powder. Next, a spark plasma sintering process was performed to the PbTe powder having the Ag nano-particles under high pressure range from 50 to 100 MPa at the temperature greater than 300° C. Thereafter, a cooling process was performed to obtain a thermoelectric material.

Comparative Example

First, a high energy ball milling process was performed to grind a PbTe material into PbTe powder. Next, a spark plasma sintering process was performed to the PbTe powder under the pressure of 100 MPa at the temperature greater than 300° C. Thereafter, a cooling process was perform to obtain a thermoelectric material.

The thermoelectric material of the example (using an electroless plating process and an electrical current activated sintering process when produced) is compared with that of the comparative example (not using an electroless plating process when produced) in the following.

Figure 3:
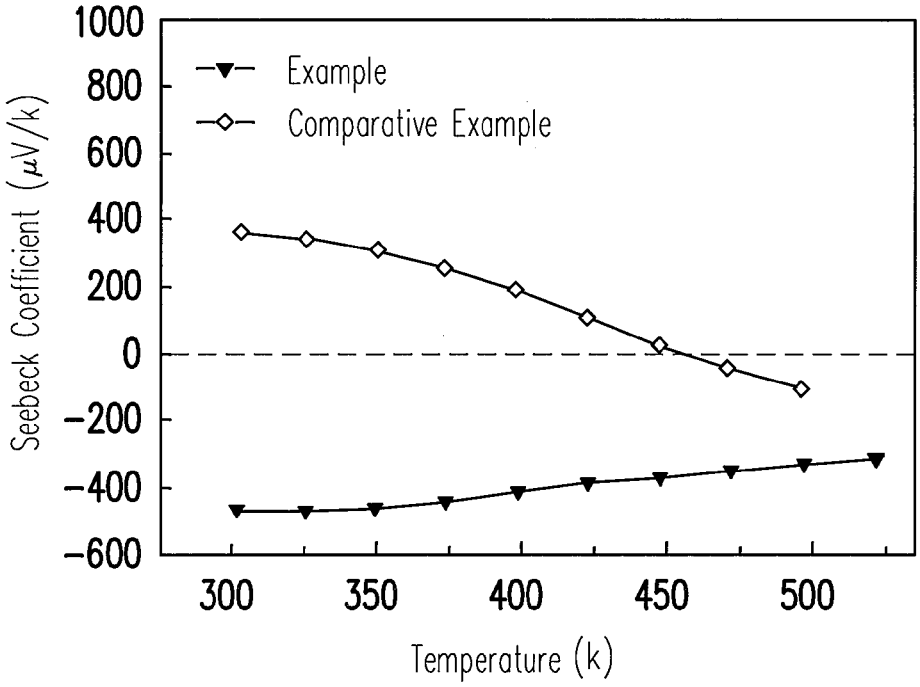
FIG. 3 illustrates the variation of Seebeck coefficient of a thermoelectric material according to different measured temperature.

FIG. 3 illustrates the variation of Seebeck coefficient of a thermoelectric material for different temperature. As shown in FIG. 3, the negative Seebeck coefficient means an N-type thermoelectric material. That is, a P-type semiconductor material can be adjusted to an N-type semiconductor material by the producing method of the disclosure. To compare with the comparative example, at room temperature, the Seebeck coefficient of the thermoelectric material of the example can be enhanced as the thermoelectric material fabricated by electroless plating process and the electrical current activated sintering process.

Figure 4:
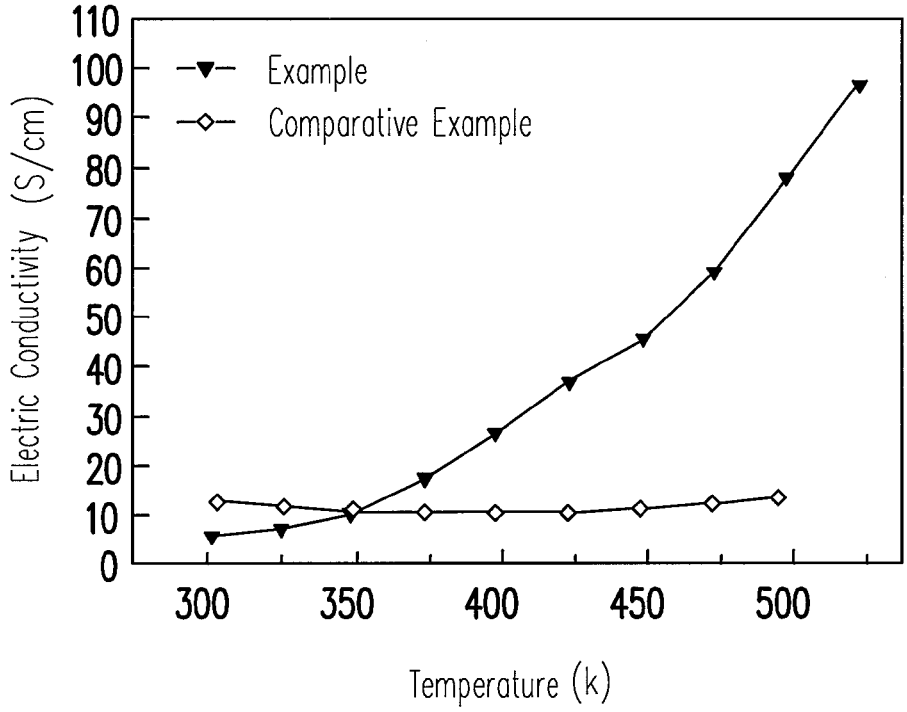
FIG. 4 illustrates the variation of electrical conductivity of a thermoelectric material according to different measured temperature.

FIG. 4 illustrates the variation of electrical conductivity of thermoelectric material according to different temperature. Referring to FIG. 4, as the temperature increased, increasing rate of the electrical conductivity of the thermoelectric material of the example is higher than that of the comparative example. That is to say, the thermoelectric material of the example has a higher electrical conductivity.

Figure 5:
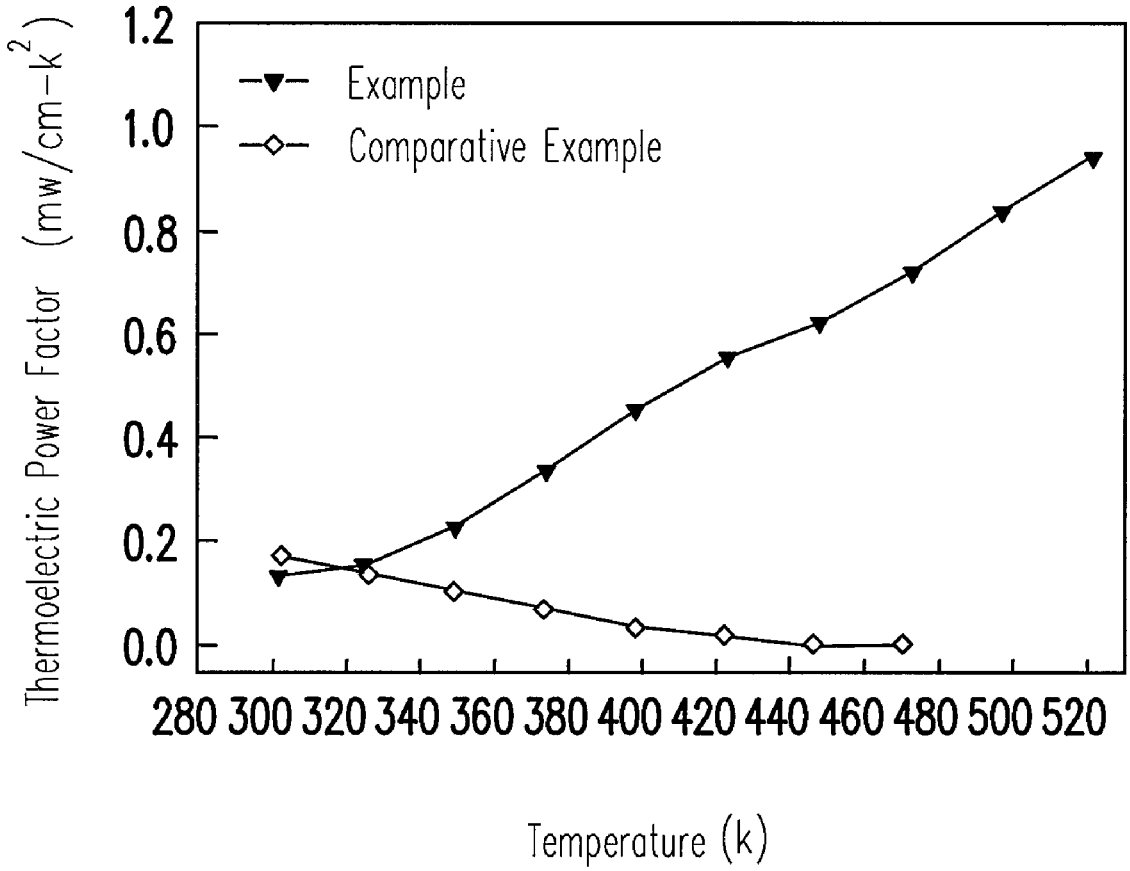
FIG. 5 illustrates the variation of thermoelectric power factor of a thermoelectric material according to different measured temperature.

FIG. 5 illustrates the variation of thermoelectric power factor of a thermoelectric material according to different temperature. Referring to FIG. 5, as the temperature increased, the thermoelectric power factor of the thermoelectric material of the example is increased while that of the comparative example is decreased. That is to say, the thermoelectric material of the example has a higher thermoelectric power factor, and the thermoelectric power factor thereof is increased by 454% compared with that of the comparative example.

In summary, in the disclosure, an electroless plating process and a electrical current activated sintering process are sequentially performed to produce a thermoelectric material with nanostructure inside, so that the produced thermoelectric material has a better Seebeck coefficient, a higher electrical conductivity and a higher thermoelectric power factor. That is, the thermoelectric material fabricated by the method in accordance with the disclosure has a higher thermoelectric figure of merit value.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A method for producing a thermoelectric material, comprising:

sensitizing a PbTe powder;

mixing a solution containing metal ions with the sensitized PbTe powder to form a mixture, wherein a part or all of the metal ions are attached on the surface of PbTe powder;

adding a reducing agent to the mixture, so that the metal ions attached on the PbTe powder are reduced to metal nano-particles; and after the metal ions attached on the PbTe powder are reduced to metal nano-particles, performing an electrical current activated sintering process to the PbTe powder with the metal nano-particle deposited thereon to form a thermoelectric material with a plurality of grain boundaries and to dope a part of the metal nano-particles into the thermoelectric material, wherein another part of the metal nano-particles remains on the grain boundaries, and the conductive type of the thermoelectric material is different from that of the PbTe powder.

2. A method for producing a thermoelectric material, comprising:

providing a PbTe powder;

performing an electroless plating process to deposit metal nano-particles on the surface of PbTe powder; and after performing the electroless plating process, performing an electrical current activated sintering process to the PbTe powder with the metal nano-particle deposited thereon to fabricate a thermoelectric material with a plurality of grain boundaries and to dope a part of the metal nano-particles into the thermoelectric material, wherein another part of the metal nano-particles remains on the plurality of grain boundaries, and a conductive type of the thermoelectric material is different from that of the PbTe powder.

3. The method of claim 2, wherein a grain size of the PbTe powder is less than 200 nm.

4. The method of claim 2, wherein a particle diameter of the PbTe powder is less than 100 μm.

5. The method of claim 2, wherein the PbTe powder is formed by a smelting process, a chemical synthesis process or performing a grinding process to a semiconductor material.

6. The method of claim 5, wherein the grinding process comprises a high energy ball milling process.

7. The method of claim 2, wherein a material of the metal nano-particles comprises silver (Ag), tin (Sn), copper (Cu) or palladium (Pd).

8. The method of claim 2, wherein a part of the metal nano-particles are used to adjust a thermoelectric property of the thermoelectric material after the step of performing the electrical current activated sintering process.

9. The method of claim 2, wherein a part of the metal nano-particles are present on the grain boundary to produce a nano-heterogeneous boundary.

10. The method of claim 2, wherein the electrical current activated sintering process comprises a spark plasma sintering (SPS) process.

11. The method of claim 2, wherein the electrical current activated sintering process is performed under the pressure of 100 MPa.

* * * * *